US009349523B2

(12) United States Patent
Jacobson et al.

(10) Patent No.: US 9,349,523 B2
(45) Date of Patent: May 24, 2016

(54) COMPACT MAGNETICS ASSEMBLY

(71) Applicant: Raytheon Company, Waltham, MA (US)

(72) Inventors: Boris S. Jacobson, Westford, MA (US); Stephen R. Elkins, Franklin, MA (US); Bradley S. Jaworski, Bedford, MA (US); Erik T. Kazior, Sudbury, MA (US)

(73) Assignee: RAYTHEON COMPANY, Waltham, MA (US)

( * ) Notice: Subject to any disclaimer, the term of this patent is extended or adjusted under 35 U.S.C. 154(b) by 94 days.

(21) Appl. No.: 13/941,624

(22) Filed: Jul. 15, 2013

(65) Prior Publication Data

US 2015/0015356 A1 Jan. 15, 2015

(51) Int. Cl.

| | |
|---|---|
| ***H01F 27/28*** | (2006.01) |
| ***H01F 21/02*** | (2006.01) |
| ***H01F 27/38*** | (2006.01) |
| ***H01F 41/10*** | (2006.01) |

(52) U.S. Cl.

CPC ..... *H01F 27/2823* (2013.01); *H01F 27/2828* (2013.01); *H01F 27/38* (2013.01); *H01F 41/10* (2013.01); *Y10T 29/49071* (2015.01); *Y10T 29/49174* (2015.01)

(58) Field of Classification Search

CPC ..... H01F 27/28
USPC ..... 336/73
See application file for complete search history.

(56) References Cited

U.S. PATENT DOCUMENTS

| | | | |
|---|---|---|---|
| 3,043,000 | A | 7/1962 | Hatfield et al. |
| 4,268,957 | A | 5/1981 | Sbuelz |
| 4,623,771 | A | 11/1986 | Sakino |
| 5,517,755 | A | 5/1996 | Wright |
| 5,545,966 | A | 8/1996 | Ramos et al. |
| 5,808,535 | A | 9/1998 | Delucia |
| 6,349,044 | B1 * | 2/2002 | Canales-Abarca et al. ..... 363/17 |
| 6,384,703 | B1 | 5/2002 | Ramos et al. |
| 6,885,268 | B2 | 4/2005 | Choi |

(Continued)

FOREIGN PATENT DOCUMENTS

DE EP000402831 A1 * 12/1990

OTHER PUBLICATIONS

Prasai et al., "Utilizing Stray Capacitances of a Litz Wire", 40th Industry Applications Conference, 2005, vol. 3, pp. 1876-1883.

(Continued)

*Primary Examiner* — Mangtin Lian
*Assistant Examiner* — Ronald Hinson
(74) *Attorney, Agent, or Firm* — Cantor Colburn LLP

(57) ABSTRACT

A magnetic assembly to receive current having a high current and high frequency includes a transformer, at least one resonant inductor, and at least one auxiliary inductor. The resonant inductor is in electrical communication with the transformer, and the auxiliary inductor is in electrical communication with the resonant inductor. The magnetic assembly further includes at least one conductor having a first end coupled to the auxiliary inductor and a second end coupled to the transformer. The conductor extends continuously between the first and second ends without terminating to form an auxiliary winding of the auxiliary inductor, a resonant winding of the resonant inductor, and at least one primary winding of the transformer.

11 Claims, 8 Drawing Sheets

(56) References Cited

U.S. PATENT DOCUMENTS

| | | | | |
|---|---|---|---|---|
| 7,002,443 | B2 | 2/2006 | Ness et al. | |
| 7,142,085 | B2 | 11/2006 | Phadke | |
| 7,489,226 | B1 | 2/2009 | Chignola et al. | |
| 8,009,004 | B2 | 8/2011 | Ahangar et al. | |
| 2011/0038181 | A1* | 2/2011 | Yan et al. | 363/17 |
| 2012/0042588 | A1* | 2/2012 | Erickson, Jr. | 52/173.3 |
| 2013/0103023 | A1* | 4/2013 | Monson et al. | 606/33 |
| 2013/0154781 | A1* | 6/2013 | Cho | 336/180 |
| 2014/0153293 | A1* | 6/2014 | Chang et al. | 363/21.02 |

OTHER PUBLICATIONS

Skutt et al., "Leakage Inductance and Termination Effects in a High-Power Planar Magnetic Structure", Ninth Annual Applied Power Electronics Conference and Exposition, vol. 1, 1994, pp. 295-301.

Sullivan, "Optimal Choice for Number of Strands in a Litz-Wire Transformer Winding", IEEE Transactions on Power Electronics, vol. 14, No. 2, Mar. 1999, pp. 283-291.

Tang et al., "Stranded Wire with Uninsulated Strands as a Low-Cost Alternative to Litz Wire", IEEE 34th Annual Power Electronics Specialist Conference, 2003, vol. 1, pp. 289-295.

* cited by examiner

COMPACT MAGNETICS ASSEMBLY

STATEMENT OF GOVERNMENT INTEREST

This invention was made with Government support under Contract No.: N00014-09-D-0726 awarded by United States Navy. The Government has certain rights in this invention.

BACKGROUND

The present disclosure relates to magnetic assemblies, and more specifically, to a compact magnetic assembly that efficiently interconnects high frequency and high current magnetic devices.

High-density and low-loss assembly and interconnection of magnetic devices present various concerns when operating in a power range of tens of kilowatts, a current range of hundreds of amperes, and a frequency range of tens of kilohertz. The various concerns include the number of winding terminations, electromagnetic interference (EMI). High-density and low-loss assembly and interconnection of magnetic devices also invite an interest in solving issues related to interconnecting one or more subassemblies, and cooling the magnetic devices. Skin effect losses in high current conductors and leakage inductance can increase the overall power dissipation and lead to high EMI. Therefore, shielding and interconnect methods for reducing EMI are required, which add significant volume and weight to the conventional magnetic assembly. These issues are exacerbated for power converters comprising assemblies with multiple magnetics.

Typically, high frequency magnetic assemblies utilize one or more multi-stranded "Litz" wires for creating electrical connections to high frequency, high current magnetic devices. However, leakage inductance occurs when high frequency, high current flows through the Litz wire connection point, thereby increasing the radiated magnetic field and associated EMI. Consequently, additional shielding is required at the connection points. As a result, a magnetic assembly having a large number of Litz wire connection points requires an increased amount of EMI shielding, thereby preventing fabrication of a compact magnetic assembly.

SUMMARY

According to one embodiment, a magnetic assembly to receive current having a high current and high frequency comprises a transformer, at least one first inductor, and at least one second inductor. The first inductor is in electrical communication with the transformer, and the second inductor is in electrical communication with the first inductor. The magnetic assembly further includes at least one conductor having a first end coupled to the second inductor and a second end coupled to the transformer. The conductor extends continuously between the first and second ends without terminating to form an auxiliary winding of the second inductor, a resonant winding of the first inductor, and at least one primary winding of the transformer.

According to another embodiment, a method of forming a magnetic assembly to receive current having a high current and high frequency comprises disposing a first end of a conductor at a first contact point of a first inductor and disposing a second end of the conductor at a second contact point of a transformer. The method further includes extending the conductor continuously between the first and second contact points without terminating the conductor therebetween. The method further includes forming an auxiliary winding of a first inductor using a first portion of the conductor, forming a resonant winding of a second inductor using a second portion of the conductor, and forming at least one primary winding of the transformer using a third portion of the conductor.

According to yet another embodiment, a method of electrically connecting an interconnect conductor to a continuously extending conductor that forms at least one winding of a magnetic assembly comprises determining cross-section area size of single bonds for bonding the interconnect conductor. The method further includes determining a target impedance and a total contact area of the interconnect conductor. The method further includes determining a bonding pattern to electrically connect the interconnect conductor to the conductor of the magnetic assembly. The method further includes bonding the interconnect conductor to the conductor of the magnetic assembly according to the bonding pattern thereby forming an electrically conductive contact point without terminating the conductor.

Additional features are realized through the techniques of the present invention. Other embodiments and aspects of the invention are described in detail herein and are considered a part of the claimed invention. For a better understanding of the invention with the features, refer to the description and to the drawings.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
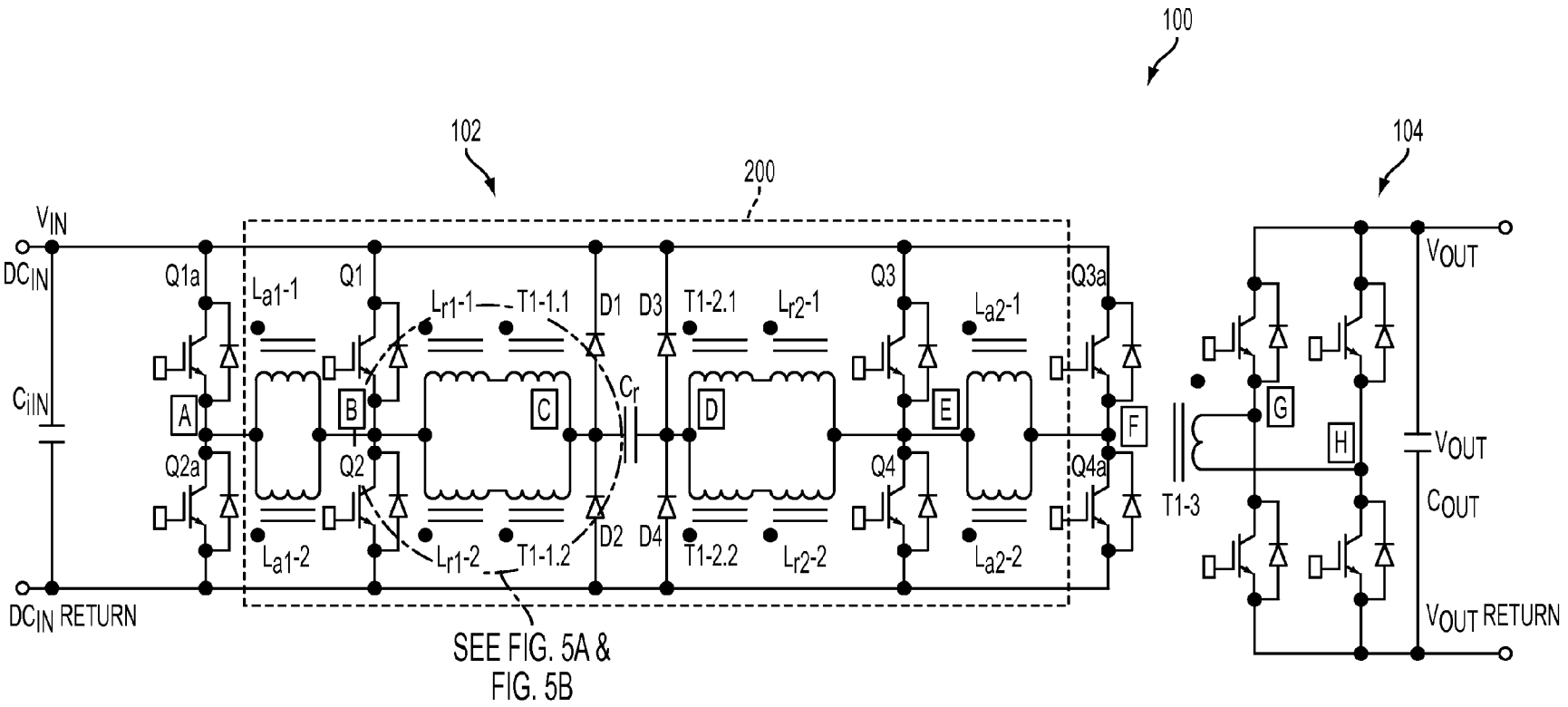
FIG. 1 is an electrical schematic of a series resonant converter (SRC) module including a magnetic assembly according to an exemplary embodiment of the disclosure.

To mitigate skin effect losses and leakage inductance in high current conductors, at least one embodiment of the disclosure provides a magnetic assembly included with one or more conductors that extend continuously without terminating to form a winding of one or more independent magnetic devices. The magnetic assembly according to at least one embodiment described herein may be utilized to construct various magnetic hardware devices. Referring to FIG. 1, for example, an electrical schematic illustrates a SRC module 100 including a magnetic assembly 200 according to an exemplary embodiment of the disclosure. By constructing the SRC module 100 to include the magnetic assembly 200 having one or more conductors that form a winding of a respective independent magnetic device without being terminated between the conductor ends, skin effect losses and leakage inductance of the magnetic assembly may be reduced.

According to at least one exemplary embodiment, the SRC module 100 may be switched at 100 kHz to generate a galvanically-isolated output of 500 VDC at 62,500 W. The SRC module 100 includes a primary bridge unit 102 and a secondary bridge unit 104. The primary bridge unit 102 includes the magnetic assembly 200. The magnetic assembly 200 includes, for example, five independent magnetic devices: a transformer T1, two first inductors (e.g., resonant inductors) Lr1 and Lr2, and two second inductors (e.g., auxiliary inductors) La1 and La2. It can be appreciated that a resonant inductor may be referred to as a second inductor and an auxiliary inductor may be referred to as a first inductor.

Each resonant inductor Lr1, Lr2, includes respective resonant windings, and each auxiliary inductor La1, La2 includes respective auxiliary windings. The transformer T1 includes two primary windings T1-1, T1-2. The secondary bridge unit 104 may include a secondary winding T1-3 that electrically communicates with the primary windings T1-1, T1-2 via an electromagnetic field. The full load and high input line correspond to the highest continuous currents of the independent magnetic devices. In the exemplary embodiment shown in FIG. 1, the resonant inductor Lr1 carries a root-means-square (RMS) current of approximately 263 amperes (A), and the inductor Lr2 carries a RMS current of approximately 192 A, while the auxiliary inductors La1 and La2 carry relatively low currents of approximately 41 A RMS, each.

Figure 2:
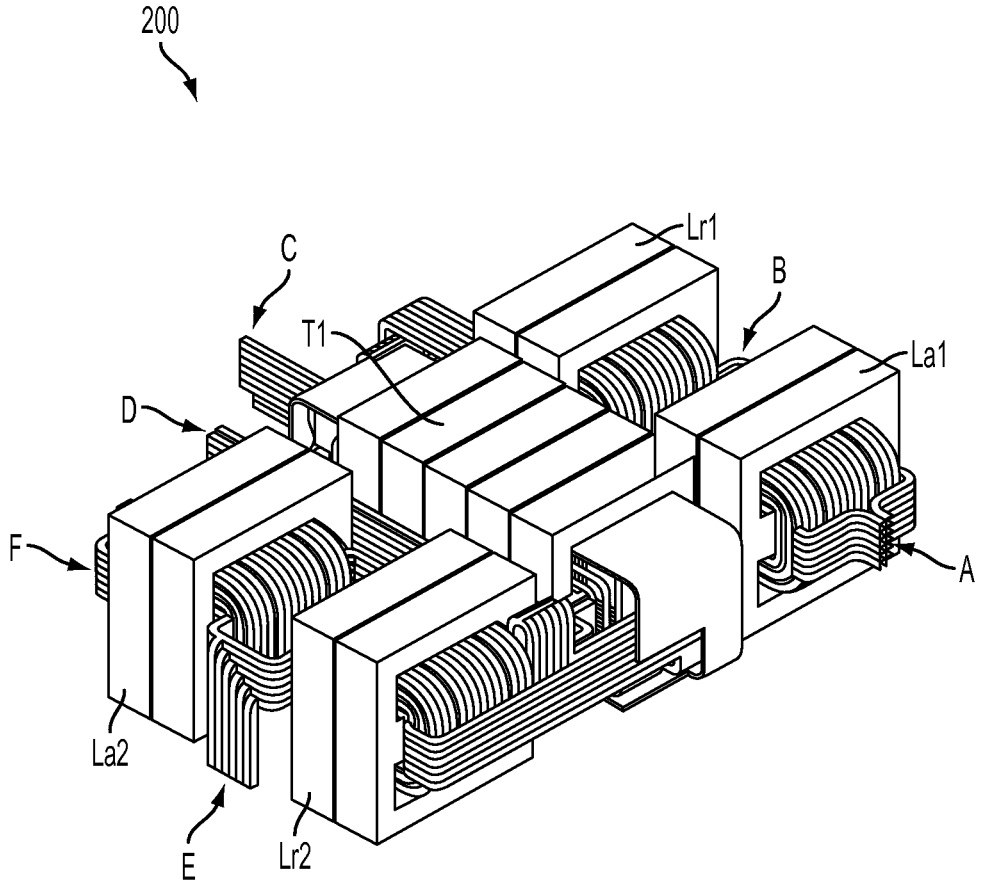
FIG. 2 is an isometric view illustrating a magnetic assembly including cores disposed through winding of independent magnetic devices according to an exemplary embodiment of the disclosure.
Figure 3:
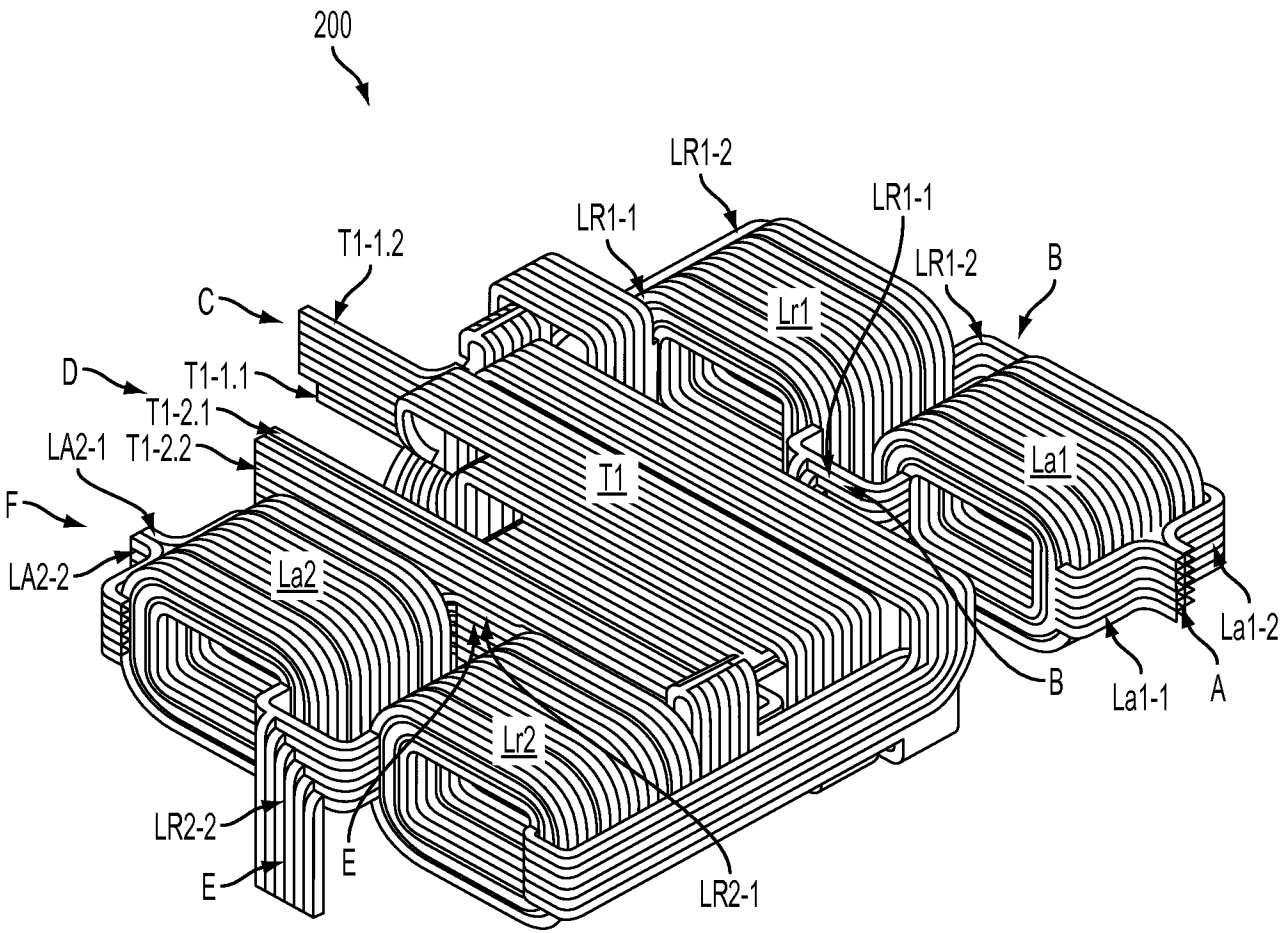
FIG. 3 is an isometric view of the magnetic assembly illustrated in following removal of the cores.
Figure 4:
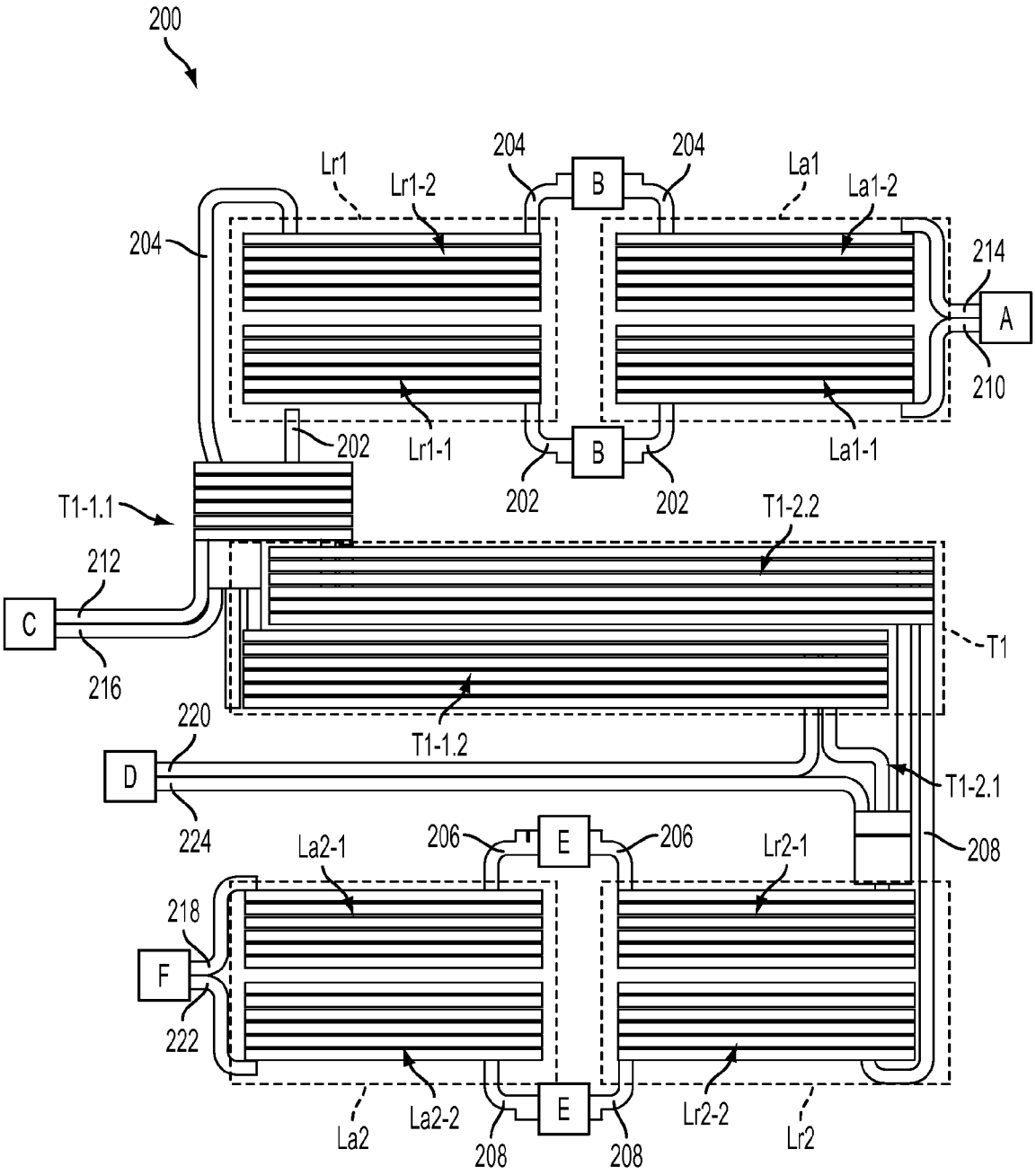
FIG. 4 is wiring diagram of the magnetic assembly illustrated in FIGS. 2 and 3.

Based on the current parameters described above, a conventional SRC module would require excessively large terminals to connect each individual magnetic device, thereby increasing the overall size of the SRC module. Further, the large terminals would increase the gap between the two conductors forming the transformer windings, which carry current in opposite directions, thereby increasing leakage inductance. However, the magnetic assembly 200 according to at least one exemplary embodiment provides at least one conductor that continuously extends between the first and second ends thereof without terminating, and forms the auxiliary winding of at least one auxiliary inductor, the resonant winding of at least one resonant inductor, and at least one primary winding of the transformer. The conductor may be formed as a electrically conductive "Litz wire", for example, A magnetic assembly 200 according to an exemplary embodiment of the disclosure is illustrated in FIGS. 2-4. As discussed above, the magnetic assembly 200 includes a transformer T1, two resonant inductors Lr1 and Lr2, and two auxiliary inductors La1 and La2. The transformer T1 includes two primary windings T1-1 and T1-2. The resonant inductors Lr1, Lr2 each include a respective resonant winding, and the auxiliary inductors La1, La2 each include a respective auxiliary winding. In at least one exemplary embodiment illustrated in FIGS. 2-4, the windings may be formed in pairs to withstand the flow of excessively high current. For example, the primary winding T1-1 may include a pair of windings T1-1.1 and T1-1.2. The primary winding T1-2 may include a pair of windings T1-2.1 and T1-2.2. The resonant windings and the auxiliary windings may also be formed in pairs. As illustrated in FIGS. 2-4, the resonant inductor Lr1 may include windings Lr1-1 and Lr1-2. The resonant inductor Lr2 may include the windings Lr2-1 and Lr2-2. The auxiliary inductor La1 may include windings La1-1 and La1-2. Finally, the auxiliary inductor La2 may include windings La2-1 and La2-2.

Figure 5A:
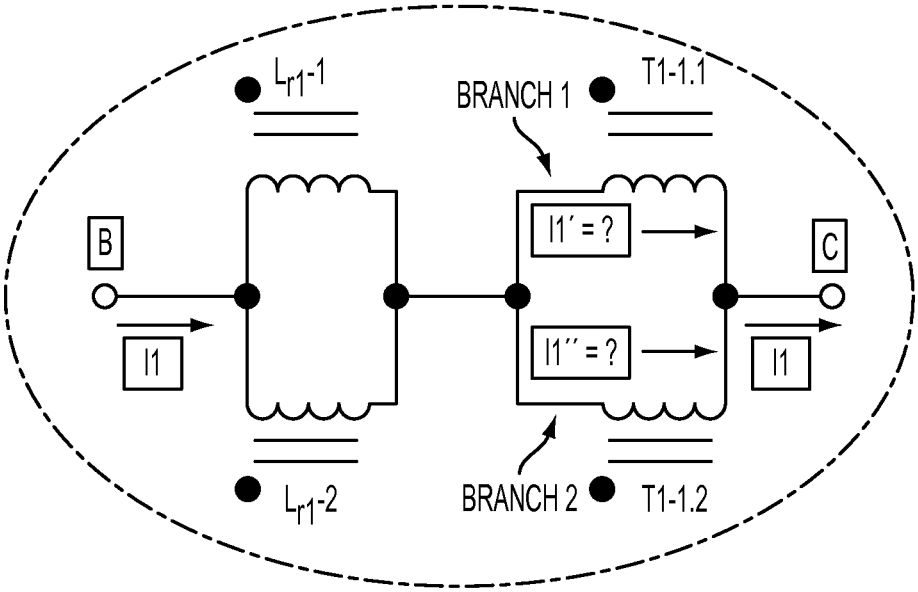
FIG. 5A is an electrical schematic illustrating branches of a transformer connected in parallel according to an embodiment of the disclosure.
Figure 5B:
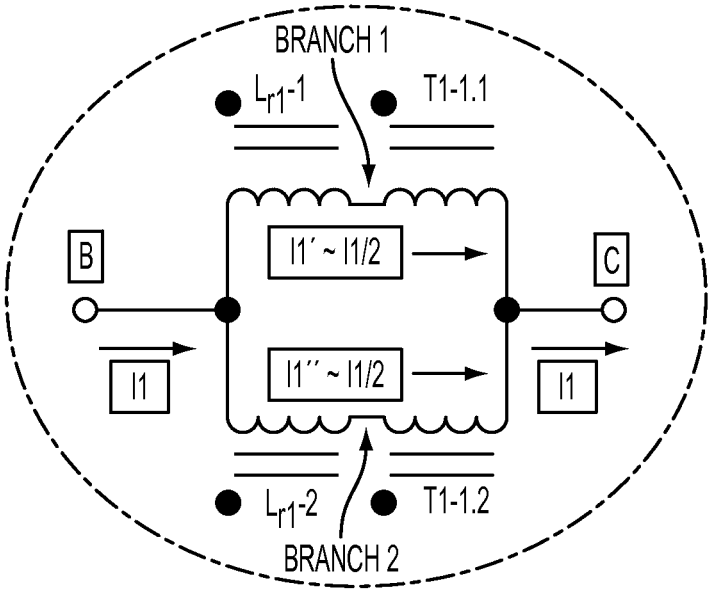
FIG. 5B is an electrical schematic illustrating branches of a transformer connected in series according to an embodiment of the disclosure.

The first and second resonant inductors Lr1, LR2 may be connected to the transformer T1 in various manners. For example, the first and second resonant inductors Lr1, Lr2 may each be connected in parallel with the transformer T1, as illustrated in FIG. 5A. Alternatively, the first and second resonant inductors may each be connected in series with the transformer as illustrated in FIG. 5B. The series connection divides the current output from the first resonant inductor Lr1 equally with respect to the first portion T1-1.1 and the second portion T1-1.2 of the transformer T1.

Each of the windings corresponding to the transformer T1, the resonant inductors Tr1, Tr2 and the auxiliary inductors Ta1, Ta2 are formed by a continuous conductor. Referring to FIG. 4, for example, the magnetic assembly 200 includes a first conductor 202, a second conductor 204, a third conductor 206, and fourth conductor 208. The first conductor 202 has a first end 210 coupled to the first auxiliary inductor La1 and a second end 212 coupled to a first node of the transformer T1. The first conductor 202 extends continuously between the first and second ends 210, 212 without terminating to form a first auxiliary winding portion (i.e., winding La1-2) of the first auxiliary inductor La1, a first resonant winding portion (i.e., winding Lr1-1) of the first resonant inductor Lr1, and a first portion of the first primary winding (i.e., winding T1-1.1) of the transformer T1.

The second conductor 204 has a first end coupled 214 to the first auxiliary inductor and a second end 216 coupled to the first node of the transformer T1. The second conductor 204 extends continuously between the first and second ends 214, 216 without terminating to form a second auxiliary winding portion (i.e., winding La1-2) of the first auxiliary inductor La1, a second resonant winding portion (i.e., winding Lr1-2) of the first resonant inductor Lr1, and a second portion of a first primary winding (i.e., winding T1-1.2) of the transformer T1.

The third conductor 206 has a first end 218 coupled to the second auxiliary inductor La2 and a second end 220 coupled to a second node of the transformer T1. The third conductor 206 extends continuously between the first and second ends 218, 220 without terminating to form a first auxiliary winding portion (i.e., winding La2-1) of the second auxiliary inductor La2, a first resonant winding portion (i.e., winding Lr2-1) of the second resonant inductor Lr2, and a first portion of a second primary winding (i.e., T1-2.1) of the transformer T1.

The fourth conductor 208 has a first end 222 coupled to the second auxiliary inductor La2 and a second end 224 coupled to the second node of the transformer T1. The fourth conductor 208 extends continuously between the first and second ends 222, 224 without terminating to form a second auxiliary winding portion (i.e., winding La2-2) of the second auxiliary inductor La2, a second resonant winding portion (i.e., winding Lr2-2) of the second resonant inductor Lr2, and a second portion of a second primary winding (i.e., winding T1-2.2) of the transformer T1.

The magnetic assembly 200 according to at least one exemplary embodiment further includes one or more contact points (A-F) located on one or more of the conductors 202-208. The first end 210 of the first conductor 202 and the first end 214 of the second conductor 204 may be coupled to one another at a contact point A. The second end 212 of the first conductor 202 and the second end 216 of the second conductor 204 may be coupled to one another at a contact point C. The first end 218 of the third conductor 206 and the first end 222 of the fourth conductor 208 may be coupled to one another at a contact point F. The second end 220 of the third conductor 206 and the second end 224 of the fourth conductor 208 may be coupled to one another at a contact point D. Accordingly, at least one embodiment of the disclosure described above provides a magnetic assembly 200 including one or more conductors that extend continuously without terminating to form windings of one or more independent magnetic devices. The magnetic assembly 200, therefore, may operate under high current and high frequency conditions while mitigating skin effect losses and leakage inductance in the conductors.

At least one interconnect conductor may also be coupled to at least one of the conductors 202-208 at a respective contact point A-F without terminating the conductor 202-208 between the respective first and second ends, as discussed in greater detail below. According to at least one embodiment, the at least one conductor and the at least one interconnect conductor are formed from Litz wires comprising a plurality of electrically conductive strands. The strands may be braided according to various patterns to reduce the impact of both skin effect and proximity effect.

Figure 6:
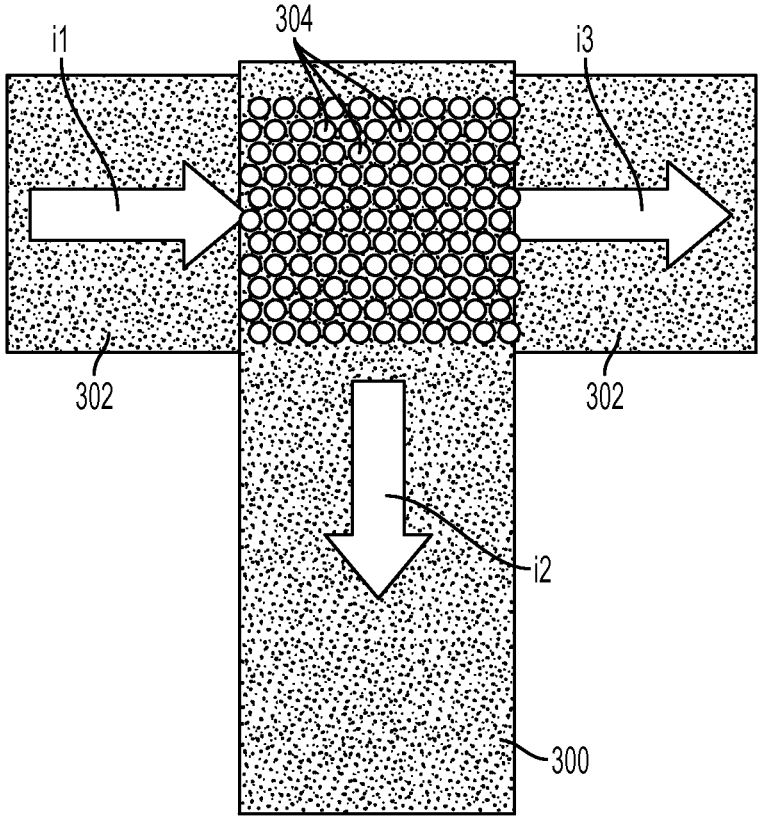
FIG. 6 is illustrates an interconnection conductor bonded to a conductor of a magnetic assembly according to an exemplary embodiment of the disclosure.

Referring to FIG. 6, an interconnect conductor 300 is shown bonded against an exterior surface of a continuous conductor 302 included in the magnetic assembly 200 to form an electrically conductive contact point. The continuous conductor 302 ultimately forms one or more windings of an independent magnetic device as described in detail above. In at least one embodiment, the interconnect conductor 300 extends perpendicular to the continuous conductor 302. Accordingly, an initial current (i1) flowing through the continuous conductor 302 will be divided at the contact point between the interconnect conductor 300 and the continuous conductor 302. As a result, a first divided current (i2) flows through the continuous conductor 302 downstream from the contact point, while a second divided current (i3) flows through the interconnect conductor 300 downstream from the contact point.

The interconnect conductor 300 and the continuous conductor 302 are formed from Litz wires comprising a plurality of electrically conductive strands, and are bonded to one another using, for example, a laser welding process. Although a laser welding process will described going forward, other bonding methods may be used including, but not limited to, resistance welding, spot welding, ultrasonic welding, and wire fusion.

Still referring to FIG. 6, a plurality of individual laser welds 304 are formed at a contact point (e.g., A-F) shared by the interconnect conductor 300 and the continuous conductor 302. The laser welds 304 are formed by applying a laser welding tool to the exposed exterior surface of the interconnect conductor 300. Each laser weld 304 may have a diameter ranging from 0.002 inches to 0.01 inches. The plurality of laser welds 304 are formed according to a randomized bonding pattern to preserve the individual conducting pattern of the braided strands corresponding to the interconnect conductor 300 and the continuous conductor 302. Further, the determined bonding pattern ensures that individual strands of the Litz wires are not bonded to one another. According to at least one embodiment, the bonding pattern is ascertained by determining a cross-section area size of single bonds formed by the laser welds 304. Then, a maximum single bond cross-section area that is less a cross-section area of an individual interconnect conductor is determined. Accordingly, individual strands of the interconnect conductor 300 and the continuous conductor 302 are not fused together.

Figure 7:
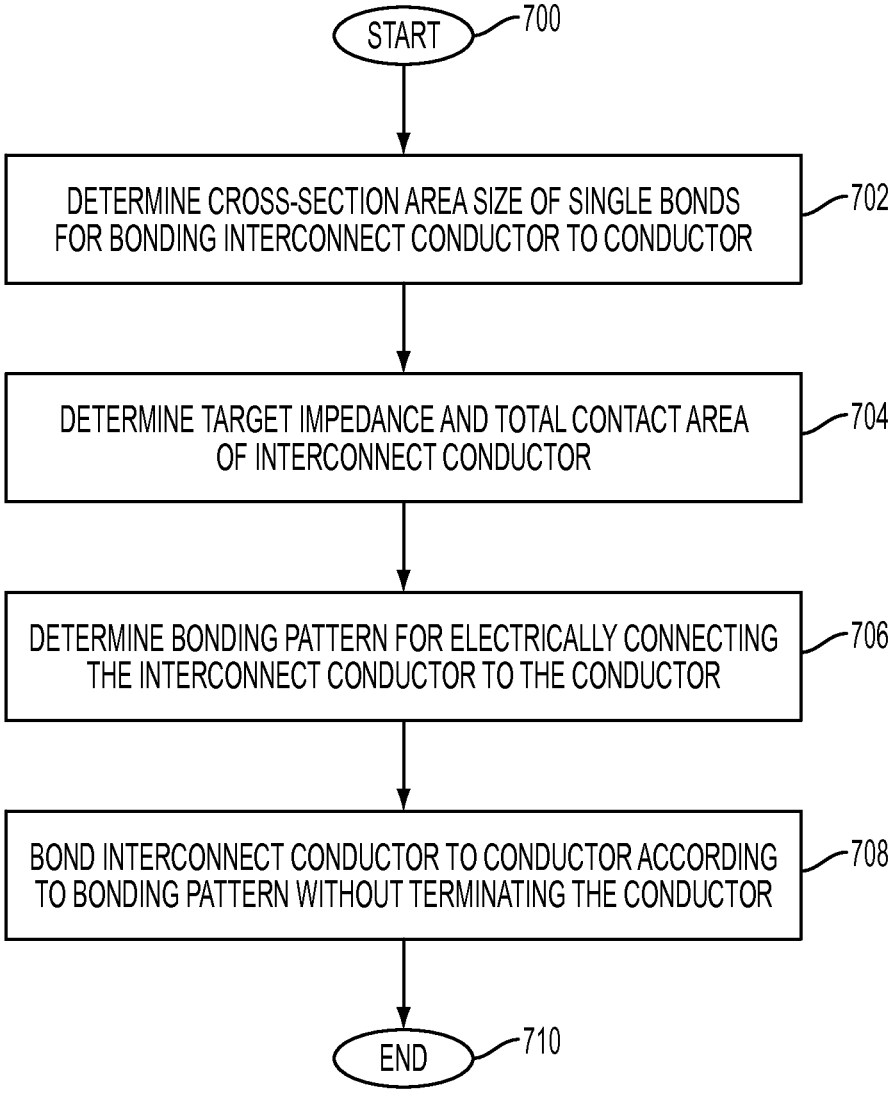
FIG. 7 is a flow diagram illustrating a method of electrically connecting an interconnect conductor to a conductor that forms at least one winding of a magnetic assembly according to an exemplary embodiment of the disclosure.

Referring now to FIG. 7, a flow diagram illustrates a method of electrically connecting an interconnect conductor to a conductor that forms at least one winding of a magnetic assembly. The method begins at operation 700, and at operation 702 a cross-section area size of single bonds for bonding the interconnect conductor to a continuous conductor forming one or more windings of an independent magnetic device is determined. The determination of the cross-section area size of single bonds may further include determining a maximum single bond cross-section area that is less a cross-section area of an individual interconnect conductor such that individual strands are not fused together. At operation 704, a target impedance and a total contact area of the interconnect conductor is determined. Target impedance of the interconnect area should not increase the aggregate impedance of the two conductors by more than few percent. By controlling the target impedance, the overall efficiency may be maintained, and the overstress of the contact area due to thermal cycling may be prevented. To satisfy this requirement, at least one embodiment determines a target contact area that covers at least 95% of Litz conductor cross section area. At operation 706, a bonding pattern is determined for electrically connecting the interconnect conductor to the continuous conductor of the magnetic assembly. The determination of the bonding pattern may include determining an arrangement of a plurality of conductive strands that form the interconnect conductor, and bonding the interconnect conductor to the conductor without bonding individual conductive strands to one another. At operation 708, the interconnect conductor is bonded to the continuous conductor of the magnetic assembly according to the bonding pattern, and the method ends at operation 710. Accordingly, an electrically conductive contact point is formed between the interconnect conductor and the conductor without terminating the conductor.

Figure 8:
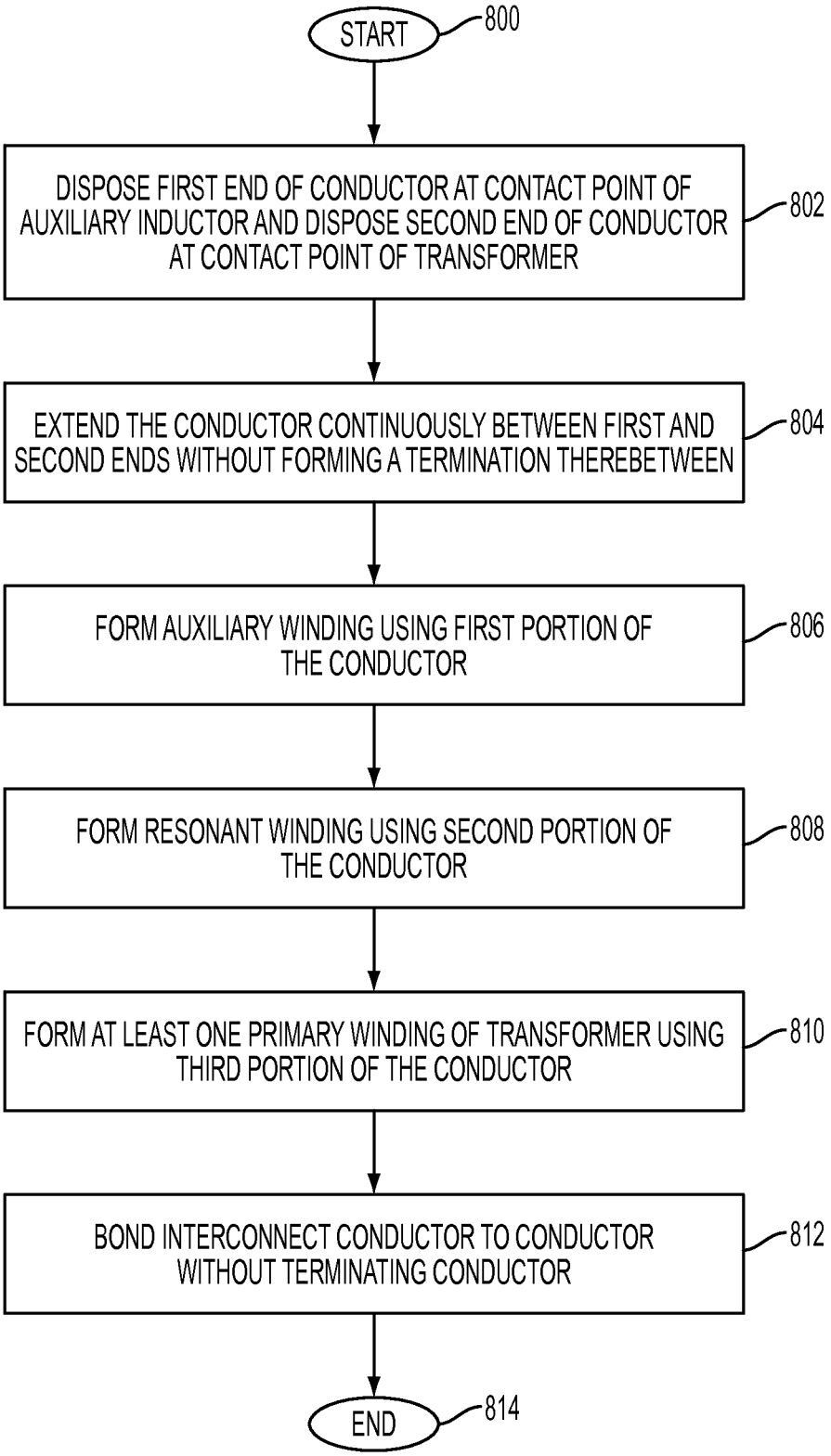
FIG. 8 is a flow diagram illustrating a method of forming a magnetic assembly to receive current having a high current and high frequency according to an exemplary embodiment of the disclosure.

Referring now to FIG. 8, a flow diagram illustrates a method of forming a magnetic assembly to receive current having a high current and high frequency according to an exemplary embodiment of the disclosure. The method begins at operation 800, and at operation 802 a first end of a conductor is disposed at a first contact point corresponding to an auxiliary inductor and a second end of the conductor is disposed at a second contact point corresponding to a transformer. At operation 804, the conductor is extended continuously between the first and second contact points without terminating the conductor between the first and second ends. At operation 806, an auxiliary winding of the auxiliary inductor is formed using a first portion of the conductor. At operation 808, a resonant winding of a resonant inductor is formed using a second portion of the conductor. At operation 810, at least one primary winding of the transformer is formed using a third portion of the conductor. At operation 812, an interconnect conductor is bonded to a contact of the conductor without terminating the conductor to electrically conductive contact point between interconnect conductor and conductor, and the method ends at operation 814.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A magnetic assembly to receive current having a high current and high frequency, the magnetic assembly comprising:

a transformer;

at least one first inductor in electrical communication with the transformer, the at least one first inductor including at least one resonant inductor includes first and second resonant inductors in electrical communication with the transformer;

at least one second inductor in electrical communication with the at least one first inductor, the at least one second inductor including first and second auxiliary inductors in electrical communication with the first and second resonant inductors, respectively; and a plurality of conductors including at least one conductor having a first end coupled to the second inductor and a second end coupled to the transformer, the at least one conductor extending continuously between the first and second ends without terminating, the at least one conductor forming an auxiliary winding of the at least one second inductor, a resonant winding of the at least one first inductor, and at least one primary winding of the transformer, the plurality of conductors forming the auxiliary winding of the at least one second inductor, the resonant winding of the at least one resonant inductor, and the at least one primary winding of the transformer, wherein a first conductor has a first end coupled to the first auxiliary inductor and a second end coupled to a first end of the transformer, the first conductor extending continuously between the first and second ends without terminating to form a first auxiliary winding portion of the first auxiliary inductor, a first resonant winding portion of the first resonant inductor, and a first portion of a first primary winding of the transformer.

2. The magnetic assembly of claim 1 wherein a second conductor has a first end coupled to the first auxiliary inductor and a second end coupled to the first end of the transformer, the second conductor extending continuously between the first and second ends without terminating to form a second auxiliary winding portion of the first auxiliary inductor, a second resonant winding portion of the first resonant inductor, and a second portion of a first primary winding of the transformer.

3. The magnetic assembly of claim 2, wherein a third conductor has a first end coupled to the second auxiliary inductor and a second end coupled to a second end of the transformer, the third conductor extending continuously between the first and second ends without terminating to form a first auxiliary winding portion of the second auxiliary inductor, a first resonant winding portion of the second resonant inductor, and a first portion of a second primary winding of the transformer.

4. The magnetic assembly of claim 3, wherein a fourth conductor has a first end coupled to the second auxiliary inductor and a second end coupled to the second end of the transformer, the fourth conductor extending continuously between the first and second ends without terminating to form a second auxiliary winding portion of the second auxiliary inductor, a second resonant winding portion of the second resonant inductor, and a second portion of a second primary winding of the transformer.

5. The magnetic assembly of claim 1, further comprising at least one interconnect conductor that is coupled to the at least one conductor without forming a termination of the at least one conductor.

6. The magnetic assembly of claim 5, wherein the at least one interconnect conductor extends perpendicular to the at least one conductor.

7. The magnetic assembly of claim 6, wherein the at least one conductor and the at least one interconnect conductor are Litz wires comprising a plurality of electrically conductive braided strands.

8. The magnetic assembly of claim 7, wherein the at least one interconnect conductor is coupled to the at least one conductor via a plurality of laser solder points.

9. The magnetic assembly of claim 8, wherein a spacing between each laser solder point exceeds a diameter of the braided strands.

10. The magnetic assembly of claim 4, wherein the first and second resonant inductors are each connected in parallel with the transformer.

11. The magnetic assembly of claim 4, wherein the first and second resonant inductors are each connected in series with the transformer such that current output from the first resonant inductor is divided equally with respect to the first and second portions of the first primary winding.

* * * * *